US007086156B2

(12) United States Patent
McLaughlin

(10) Patent No.: US 7,086,156 B2
(45) Date of Patent: Aug. 8, 2006

(54) MAGNETIC KNIFE SHEATH

(76) Inventor: Kevin W. McLaughlin, 3105 College Ave., Apt. 2, Berkeley, CA (US) 94705

( * ) Notice: Subject to any disclaimer, the term of this patent is extended or adjusted under 35 U.S.C. 154(b) by 9 days.

(21) Appl. No.: 10/444,715

(22) Filed: May 23, 2003

(65) Prior Publication Data

US 2004/0231164 A1 Nov. 25, 2004

(51) Int. Cl.
*B26B 29/02* (2006.01)

(52) U.S. Cl. ..... 30/153; 30/298.4; 211/DIG. 1

(58) Field of Classification Search ..... 30/298.4, 30/151, 153, 296.1, 504, 514; 211/DIG. 1, 211/70.7; 224/183, 232; 248/309.4; 220/483
See application file for complete search history.

(56) References Cited

U.S. PATENT DOCUMENTS

| | | | | |
|---|---|---|---|---|
| 3,008,617 | A | 11/1961 | Villwock | |
| 3,727,658 | A | 4/1973 | Eldridge, Jr. | |
| 4,183,439 | A * | 1/1980 | Bell | 211/70.7 |
| 4,492,028 | A * | 1/1985 | Bourgein | 30/298.4 |
| 4,726,498 | A * | 2/1988 | Esposito | 224/232 |
| 4,825,545 | A * | 5/1989 | Chase et al. | 30/153 |
| 4,942,663 | A * | 7/1990 | Ray, Sr. | 30/151 |
| 5,011,102 | A | 4/1991 | Kiefer | |
| 5,211,322 | A * | 5/1993 | Nealy | 224/232 |
| 5,425,160 | A | 6/1995 | Krapf | |
| 5,490,607 | A * | 2/1996 | Hsieh et al. | 220/483 |
| 5,538,132 | A | 7/1996 | Propp et al. | |
| 5,682,653 | A | 11/1997 | Berglof et al. | |
| 6,044,561 | A * | 4/2000 | Baraky et al. | 30/153 |
| 6,195,898 | B1 * | 3/2001 | Lemisch | 30/153 |
| 6,457,239 | B1 | 10/2002 | McLaughlin | |

FOREIGN PATENT DOCUMENTS

| | | |
|---|---|---|
| SE | 453 620 | 2/1988 |

* cited by examiner

*Primary Examiner*—Charles Goodman
(74) *Attorney, Agent, or Firm*—Sharon J. Adams

(57) ABSTRACT

The invention is a magnetic knife sheath that permits easy transport and protection of knives in a relatively small sheath. The sheath has either one or two magnetically charged faces. The user places the knife blade against a magnetically charged face and the knife blade is held in place by magnetic attraction between the knife and the magnetically charged face or faces.

17 Claims, 7 Drawing Sheets

MAGNETIC KNIFE SHEATH

CROSS REFERENCE TO RELATED APPLICATIONS

Not Applicable.

FEDERAL SPONSORSHIP

Not Applicable.

BACKGROUND

Professional chefs frequently carry their knives from place to place. During transport it is necessary to protect the knife blades, both to keep the blade sharp and to prevent accidentally cutting oneself. In addition, individuals at home frequently use some sort of sheath to protect and secure kitchen knives.

In order to transport their knives, professional chefs typically use a lightweight, hard plastic sheath that holds the knife blade. The plastic sheath is shaped like a long and very narrow taco shell. The bottom side is sealed. The other three sides have a very narrow slot. The knife blade must be forced into the narrow slot, between the plastic faces. The knife blade is held in place simply by the narrowness and tightness of the plastic slot.

The plastic sheath has several disadvantages. A knife blade is not immobilized between the plastic faces. The knife blade can move against the bottom of the plastic sheath, dulling the knife blade.

In addition, the plastic sheaths are solid and inflexible. They cannot be opened. Therefore, the plastic sheaths cannot be cleaned or sterilized. Chefs are often tired at the end of a long night of work, and frequently place their knives into the plastic sheaths without thoroughly cleaning the knife blade first. Because the plastic sheaths cannot be opened or cleaned, particles of food from the dirty knife blade may remain inside the plastic sheath. The invention makes it possible to open and clean the knife sheath.

Furthermore, because the plastic sheath cannot be opened, chefs may cut their hands when placing the knife blade into the plastic sheath. Placing the knife blade in the plastic sheath involves holding the plastic sheath in one hand and the knife in the other. The chef then lines up the knife blade with the very narrow slot in the plastic sheath, and pushes the knife blade into the plastic sheath. If the chef misaligns the knife blade and the slot in the plastic sheath, the knife blade may be pushed into the palm of the hand that is holding the plastic sheath. The knives are very sharp and will frequently cut the chef's hand. It is much easier and safer to place a knife blade into the invention because the invention may be opened.

Individuals at home also wish to protect and secure their knifes. The magnetic knife holders most commonly used in the home involve a large magnet, which is attached to a wall or cabinet. Alternatively, knives are frequently placed in some sort of wooden block, or some other solid material that holds the knives as a group on a countertop. These various types of knife holders take up a lot of space on a wall or cabinet. In addition, they are difficult to clean. None of the prior inventions provide a lightweight, compact means for securing and protecting knife blades.

U.S. Pat. No. 6,457,239, issued to Applicant on Oct. 1, 2002, describes a magnetic knife sheath with two parallel, flat magnets with a central hinge between the magnets. This central hinge is exposed to wear and tear due to the knife-edge hitting the hinge, and due to repeated opening and closing of the magnetic knife sheath.

BRIEF SUMMARY

There are several embodiments of the present invention. All embodiments use magnets to hold a knife blade in place in the knife sheath. In all cases, the magnets may be either flexible or hard magnets.

In one embodiment, there is a single magnetically charged face. This magnetically charged face is generally J-shaped; the magnetically charged face is flat with a trough at one side. The user inserts the knife-edge into the trough and the magnet is secured in place by magnetic attraction between the knife blade and the magnetically charged face. There is no second magnetically charged face and therefore no need for a hinge in this embodiment.

All other embodiments have two magnetically charged faces and a hinge. All of these embodiments provide protection to the hinge, either by off-setting the hinge, by modifying the shape of one magnetically charged face to protect the hinge, or by providing additional structural protection to the hinge.

In all of these embodiments, one magnetically charged face is flat. The other magnetically charged face has different shapes: flat; generally L-shaped, or generally J-shaped. In all these embodiments the magnetically charged faces are permanently affixed to a magnet support. In all these embodiments a hinge is located between the two magnetically charged faces. The hinge allows the user to open the knife sheath, place a knife against one magnetically charged face, and close the knife by means of the hinge. The hinge is located so that the two magnetically charged faces align when the invention is closed.

Figure 3:
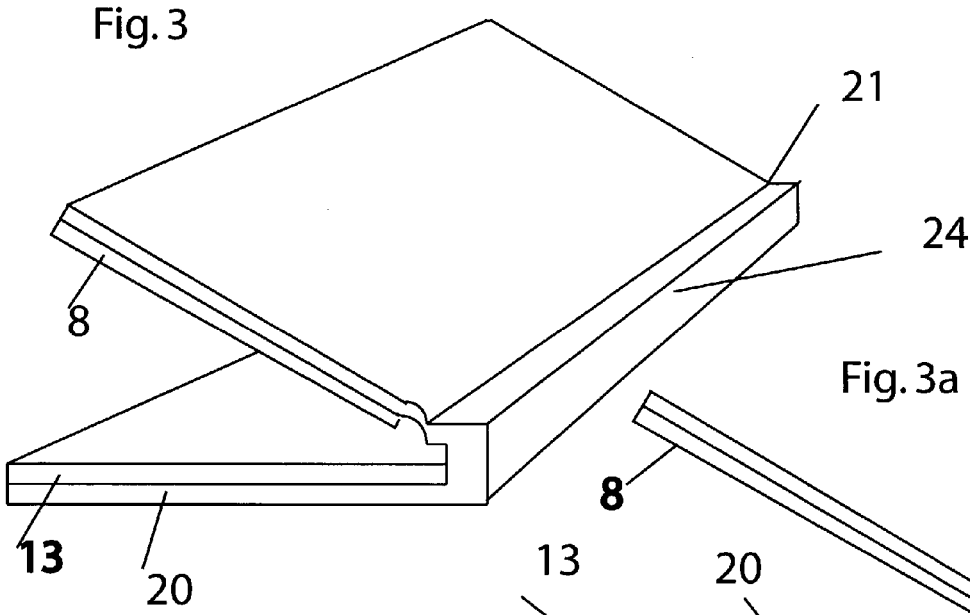
FIG. 3 is a perspective drawing of one embodiment of the invention in the partially closed position.

Fog. 3B is a cross-sectional view of the embodiment shown in FIG. 3 in the open position.

Figure 4:
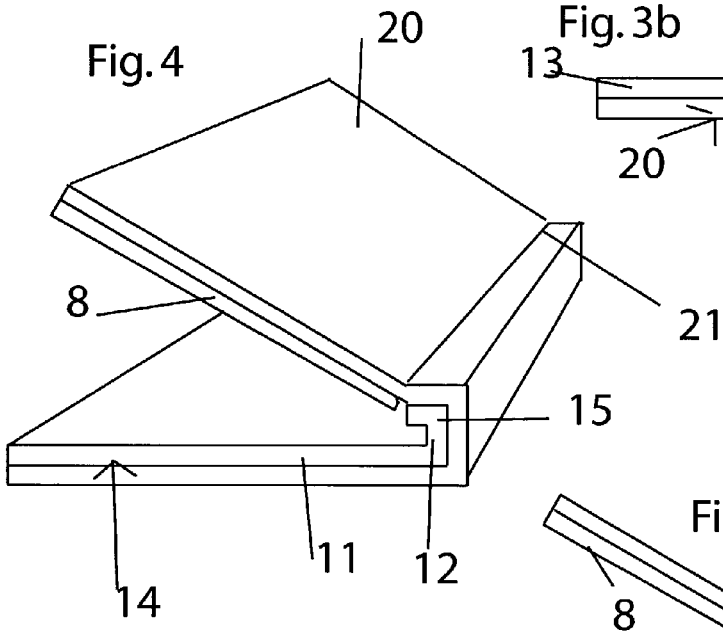

FIG. 4 is a perspective drawing of one embodiment of the invention in the partially closed position.

Figure 4A:
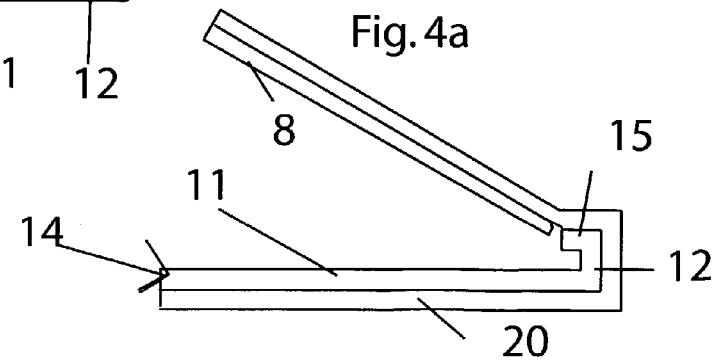

FIG. 4A is a cross-sectional view of the same view as in FIG. 4.

Figure 5:
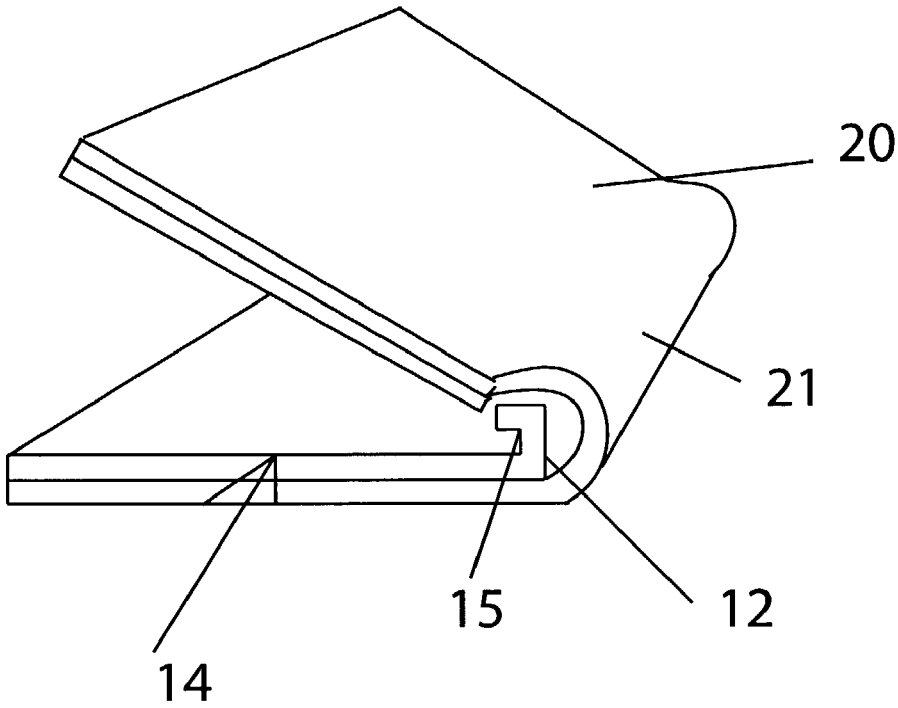

FIG. 5 is a perspective drawing of one embodiment of the invention in the partially closed position.

Figure 5A:
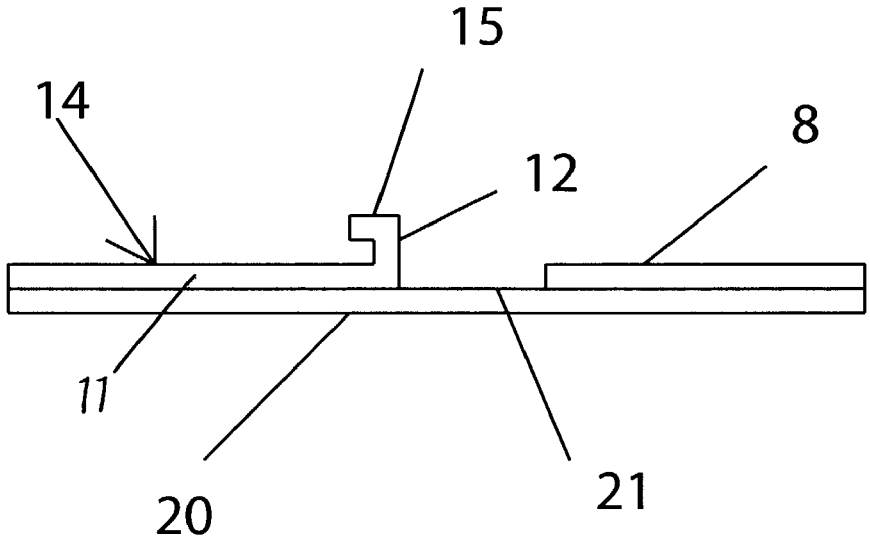

FIG. 5A is a cross-sectional view of the embodiment shown in FIG. 5 in the open position.

Figure 6:
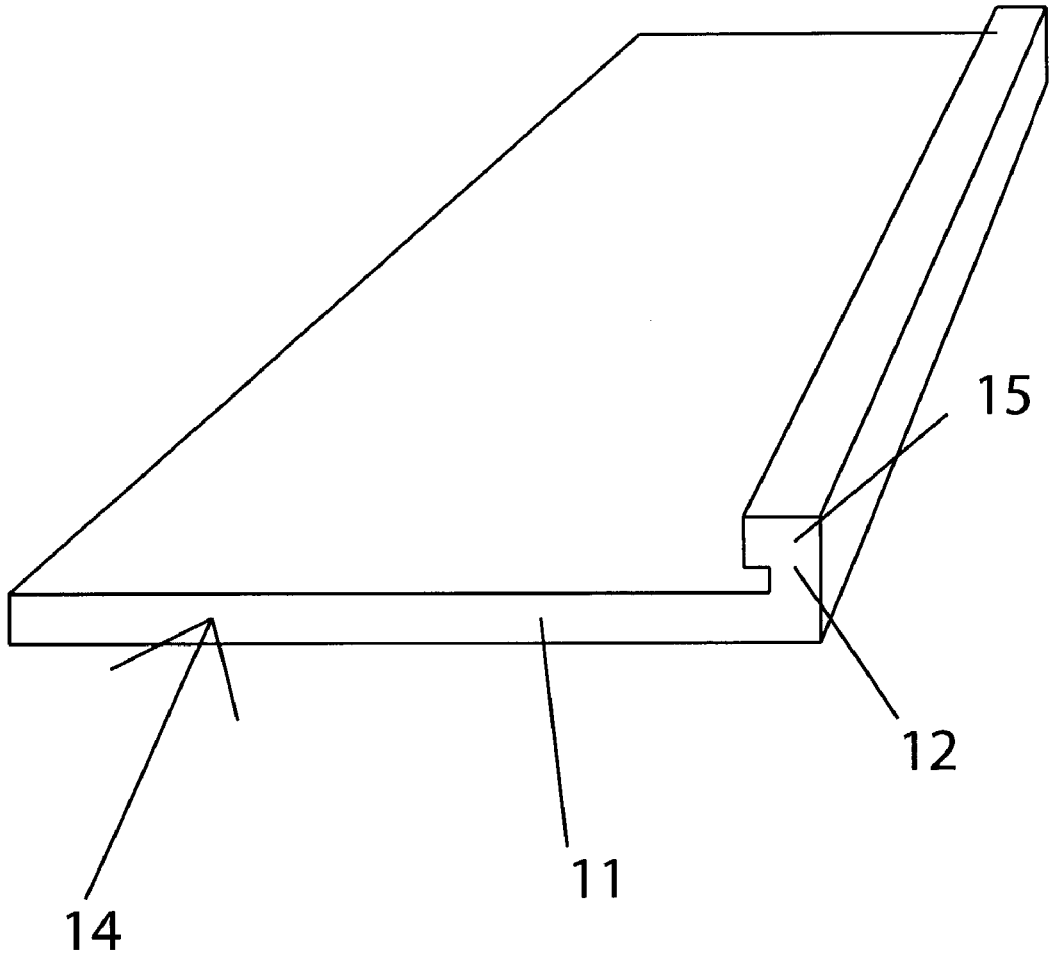

FIG. 6 is a perspective drawing of one embodiment of the invention.

Figure 7:
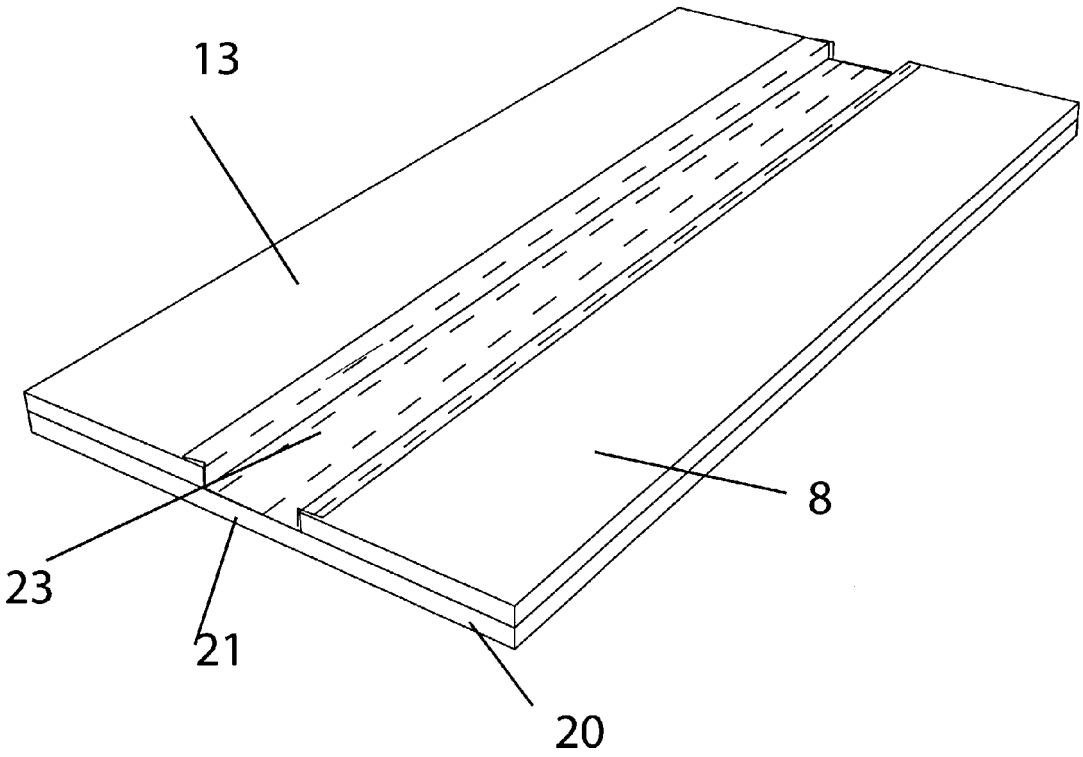

FIG. 7 is a perspective drawing of one embodiment of the invention.

Figure 7A:
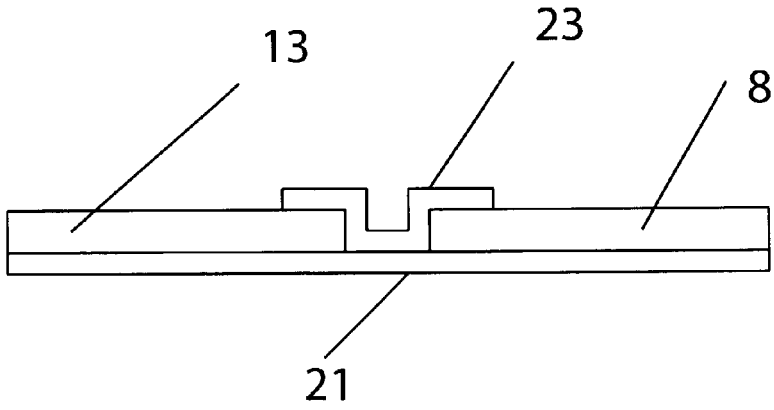

FIG. 7A is a cross-sectional view of the view shown in FIG. 7.

Figure 8:
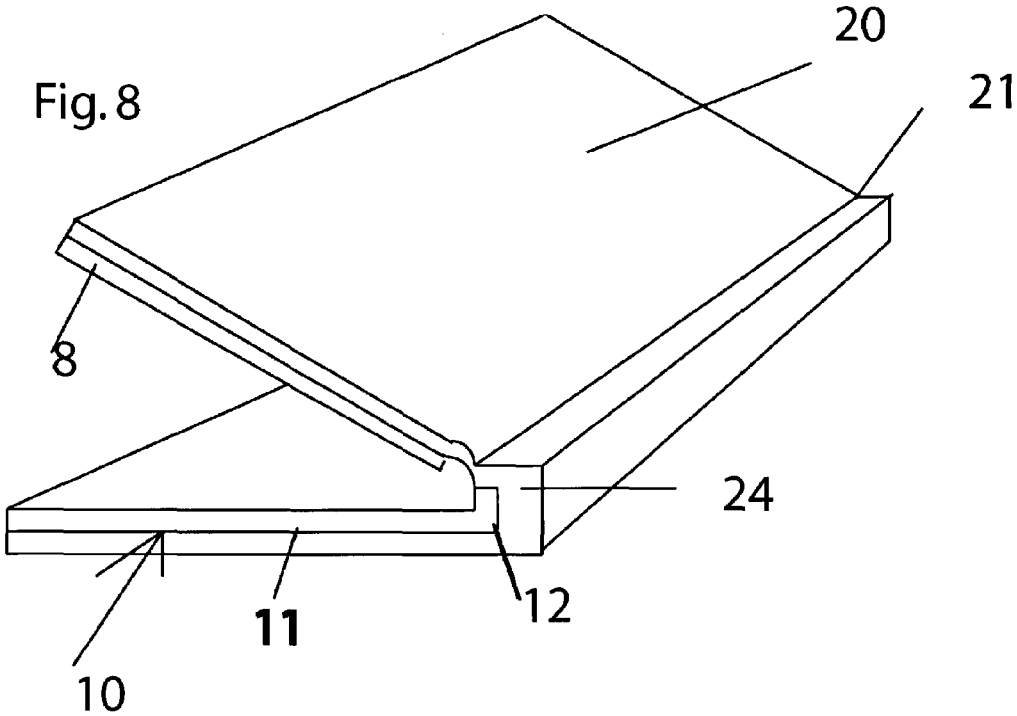

FIG. 8 is a perspective view of one embodiment of the invention.

Figure 8A:
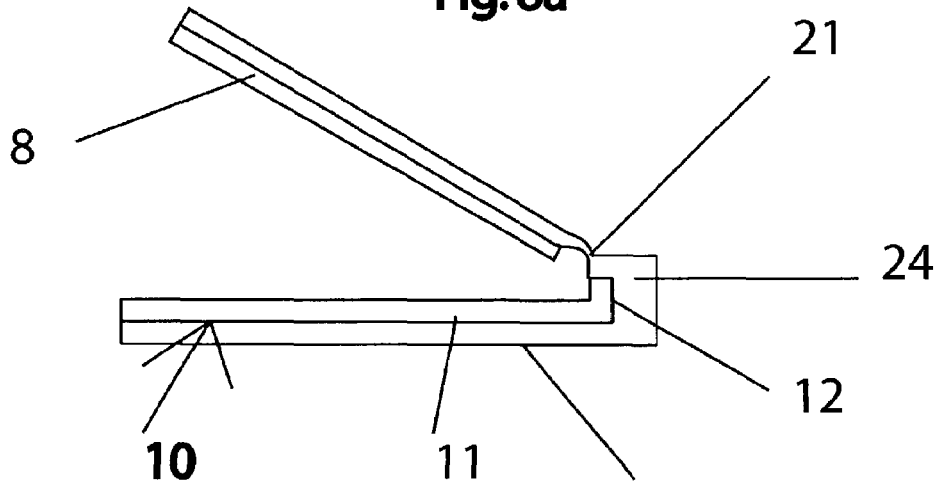

FIG. 8A is a cross-sectional view of the embodiment shown in FIG. 8.

Figure 8B:
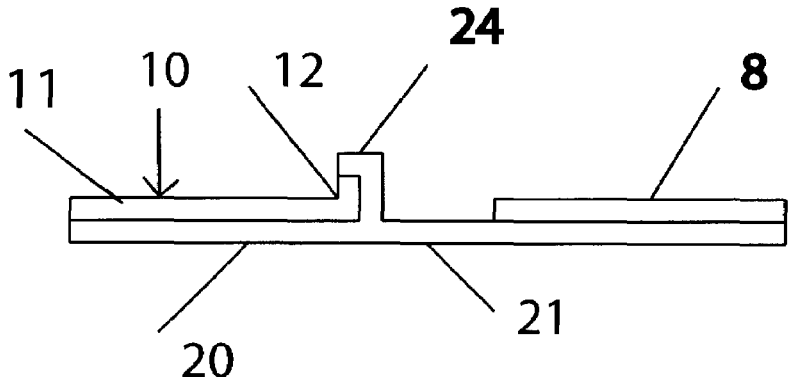

FIG. 8B is a perspective view of one embodiment of the invention.

DETAILED DESCRIPTION OF THE INVENTION

Figure 1:
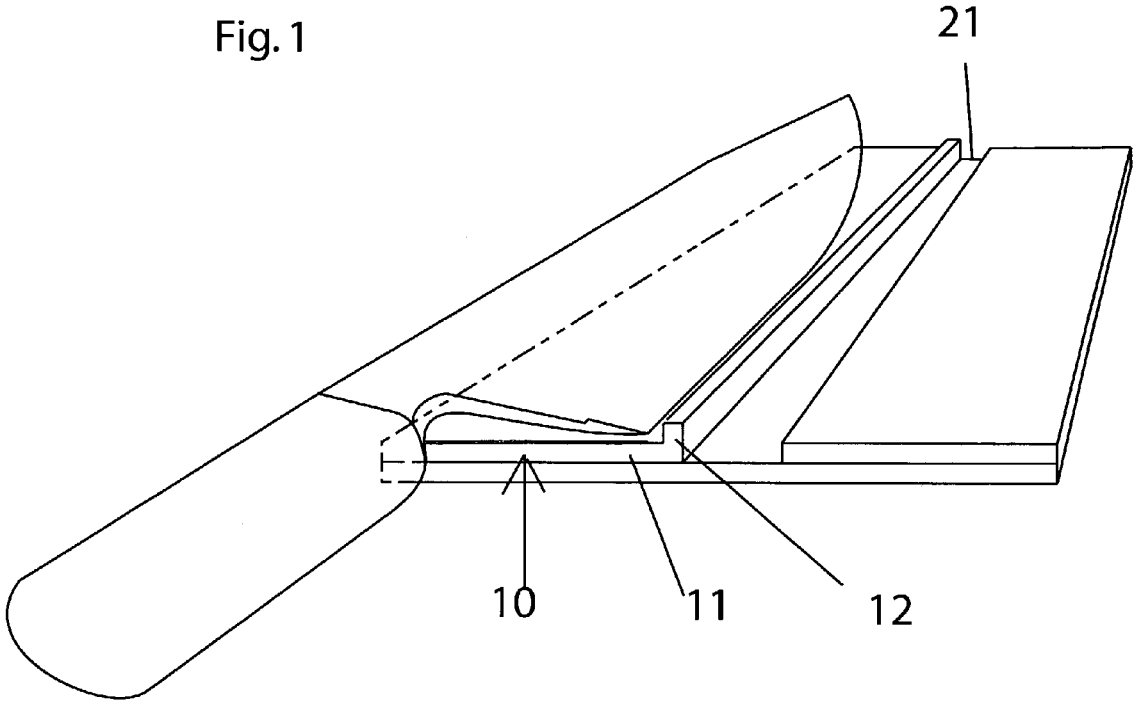
FIG. 1 is a perspective drawing of one embodiment of the invention in the open position with a knife in place.

FIG. 1 shows one embodiment of the invention. FIG. 1 shows an L-shaped magnetically charged face 10 and a second magnetically charged face 8. Magnetically charged faces 8 and 10 may be made from flexible magnets or non-flexible, hard magnets.

The second magnetically charged face 8 is a flat magnet. In this embodiment, the L-shaped magnetically charged face 10 has a long plane 11 and a short plane 12. L-shaped magnetically charged face 10 may be formed as a single unit. Alternatively, the long plane 11 and short plane 12 may be formed in any other manner so that short plane 12 extends perpendicularly from long plane 11. The use of the phrase "L-shaped" is for identification only, and is not meant to limit the angle of connection between long plane 11 and short plane 12. Thus, short plane 12 may extend perpendicularly from long plane 11 through a curve rather than a right angle. Or, as shown in FIG. 1 short plane 12 may extend at a 90-degree angle from long plane 11, forming an "L".

Magnetically charged faces 10 and 8 are permanently affixed to magnet support 20 by thermal bonding, thermal welding, pressure sensitive adhesive, or any other adhesive that will permanently attach the magnet support 20 to the magnetically charged faces. In this embodiment, only long plane 11 of magnetically charged face 10 is permanently affixed to magnet support 20. The inventor currently prefers making the magnet support 20 from flexible vinyl. However, the magnet support 20 may also be made of a wide variety of materials that may be repeatedly bent without breaking, for example, high-density polymers, rubber, paper, plastic, or leather.

As shown in FIG. 1, hinge 21 is made of the same material as magnet support 20, and is the same thickness as magnet support 20. Hinge 21 is located between long plane 11 and second magnetically charged face 8.

Figure 1A:
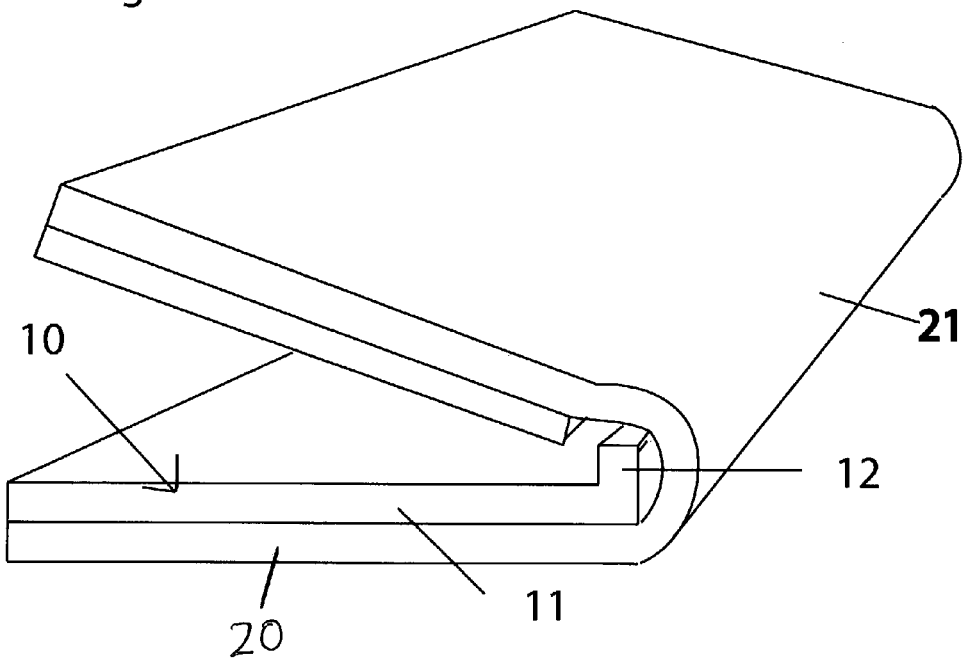
FIG. 1A is a perspective drawing of the same embodiment as in FIG. 1 in a partially closed position.

As shown in FIG. 1A, hinge 21 allows the magnet support to curve around short plane 12. Also as shown in FIG. 1A, hinge 21 is located on magnet support 20 so that magnetically charged faces 8 and 10 align when the knife sheath is in the closed position. The second magnetically charged face is thereby magnetically attracted to first magnetically charged face 10, holding the knife sheath closed. If a knife is placed in the knife sheath the magnetically charged faces will be attracted to the knife, as well, and will secure the knife in the knife sheath.

FIGS. 8 and 8A show an alternative embodiment using L-shaped magnetically charged face 10. In this embodiment, magnet support 20 is permanently affixed to long plane 11. Magnet support 20 has projection 24. Projection 24 is made of the same material as magnet support 20. Projection 24 is permanently affixed to the side and top of short plane 12. Projection 24 wraps around the end of magnetically charged face 10 and extends slightly beyond magnetically charged face 10. Projection 24 then bends up so that it is parallel to magnetically charged face 10. Projection 24 forms a gap next to magnetically charged face 10. A knife-edge is inserted into this gap. Hinge 21 is located between projection 24 and magnetically charged face 8. The inventor currently prefers forming projection 24 so that a ⅛" gap is created. However, it is apparent that the size projection 24 may be varied to accommodate different sizes of knife blades. Hinge 21 is thus off-center, and is protected from the knife-edge. Hinge 21 is located on the same said of the device as magnetically charged face 8.

FIG. 8B shows another embodiment using L-shaped magnetically charged face 10. In this embodiment, projection 24 wraps around short plane 12, as described above. Hinge 21, however, is in the center of the invention, and is located between projection 24 and second magnetically charged face 8. In this embodiment, the L-shape of L-shaped magnetically charged face 10 protects hinge 21 from the knife-edge.

Figure 3A:
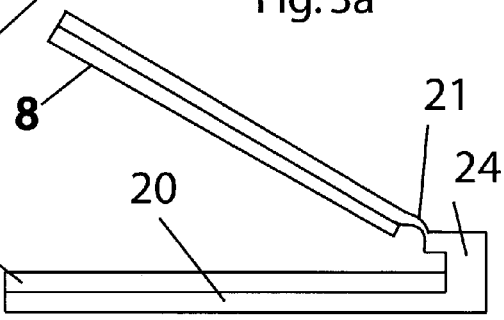
FIG. 3A is a cross-sectional view of the same view as in FIG. 3.

FIGS. 3 and 3A show another embodiment of the invention. This embodiment has a first flat magnetically charged face 13 and a second flat magnetically charged face 8. Both magnetically charged faces are permanently affixed to magnet support 20. Projection 24 is made of the same material as magnet support 20. Projection 24 wraps around the end of magnetically charged face 13 and extends slightly beyond magnetically charged face 13. Projection 24 then bends up so that it is parallel to magnetically charged face 13. Projection 24 forms a gap next to magnetically charged face 13. A knife-edge is inserted into this gap. Hinge 21 is located between projection 24 and magnetically charged face 8. Hinge 21 is thus off-center, and is protected from the knife-edge. The inventor currently prefers forming projection 24 so that a ⅛" gap is created. However, it is apparent that the size projection 24 may be varied to accommodate different sizes of knife blades.

Figure 3B:
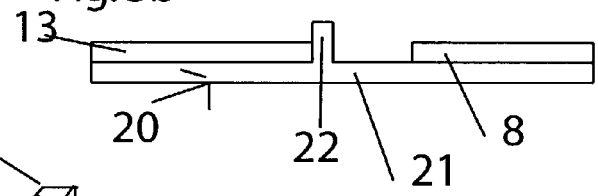

Another embodiment using flat magnetically charged face 13 is shown in FIG. 3B. As shown in FIG. 3B, lip 22 is perpendicularly attached to magnet support 20. Lip 22 is preferably made from the same material as magnet support 20. Hinge 21 is located between lip 22 and second magnetically charged face 8. In this embodiment, magnet support 20 is permanently affixed to long plane 11. Hinge 21 is located between lip 22 and second magnetically charged face 8. Lip 22 is placed on magnet support 20 so that the magnetically charged faces 13 and 8 align when magnet support 20 curves over lip 22 through hinge 21. The length of lip 22 must be sufficient to extend beyond approximately ⅛" beyond magnetically charged face 13. However, it is apparent that the length of lip 22 may be adjusted as needed to accommodate different knife thicknesses.

FIGS. 3 and 3A show a variation of hinge 21. This variation may be used in any of the embodiments with two magnetically charged faces described herein. In this embodiment, hinge 21 is made of the same material as magnet support 20, but is thinner than magnet support 20. The thickness of hinge 21 may be varied in any of the embodiments described herein.

Figure 2:
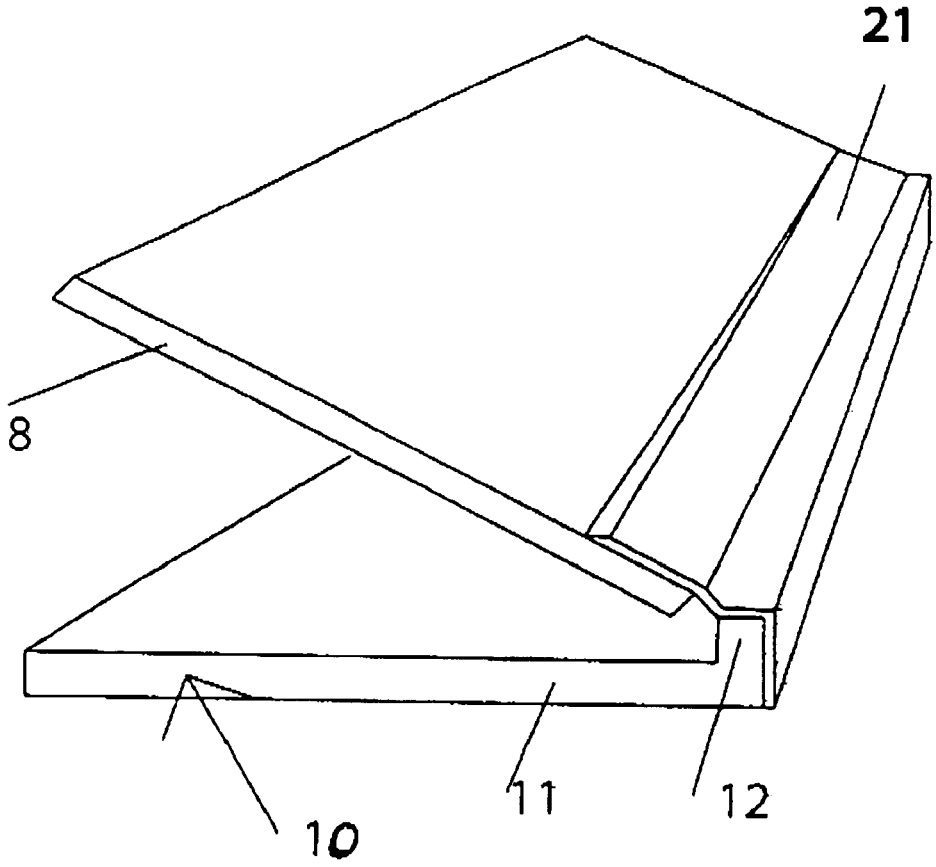
FIG. 2 is a perspective drawing of one embodiment of the invention in the partially closed position.
Figure 2A:
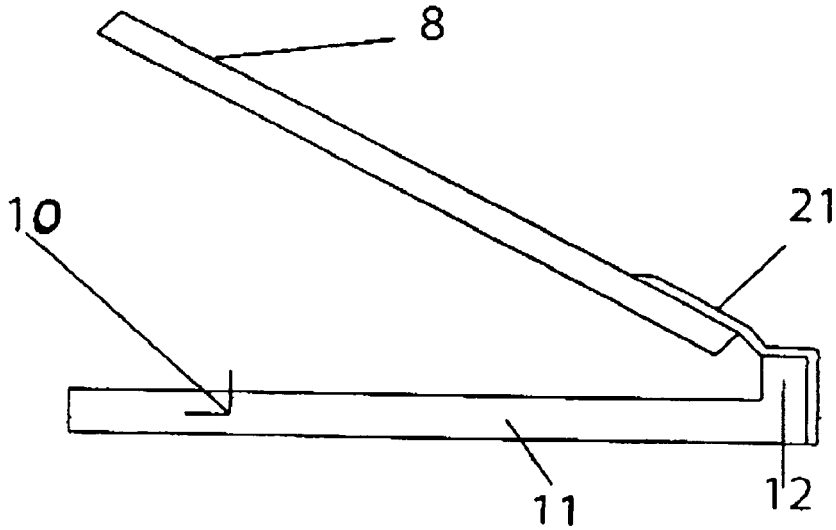
FIG. 2A is a cross-sectional view of the same view as in FIG. 2.

FIGS. 2 and 2A show another embodiment of the invention using an L-shaped magnet. This embodiment has a first magnetically charged face 10 that is L-shaped. First magnetically charged face 10 has a long plane 11 and a short plane 12. Second magnetically charged face 8 is flat. Hinge 21 moveably connects first magnetically charged face and second magnetically charged face 8. Hinge 21 is made from flexible vinyl, polymers, rubber, leather, plastic or paper, or any material that may be repeatedly bent without breaking. Hinge 21 is permanently affixed to the magnetically charged faces 8 and 10. Hinge 21 will be offset from the center of the invention due to the L-shape of first magnetically charged face 10. Hinge 21 is protected from the knife-edge by the L-shape of first magnetically charged face 10. Hinge 21 allows the magnetically charged faces 8 and 10 to open and close. A knife will be secured by magnetic forces when it is placed in between the magnetically charged faces 8 and 10 and hinge 22 is closed.

FIG. 4 shows another embodiment of the invention. In this embodiment, J-shaped magnetically charged face 14 has a long plane 11, a short plane 12, and a second short plane 15. Short plane 12 extends perpendicularly from long plane 11, as described above. Second short plane 15 extends perpendicularly form short plane 12 to form a trough. The trough must be of sufficient size to accommodate the edge of a knife blade.

J-shaped magnetically charged face 14 may be formed as a single unit. Alternatively, the long plane 11 and short planes 12 and 15 may be formed in any other manner to form a trough. The use of the phrase "J-shaped" is for identification only, and is not meant to limit the angles of connection between long plane 11 and short planes 12 and 15. Thus, short plane 12 may extend may extend perpendicularly from long plane 11 through a curve rather than a right angle. And, short plane 15 may extend perpendicularly from short plane 12 through a curve rather than a right angle. Or, as shown in FIG. 4 short planes 12 and 15 may extend at 90-degree angles.

FIGS. 4 and 4A show magnet support 20 permanently affixed to long plane 11, short plane 12 and second short plane 15. Hinge 21 will thus be offset from the center of the invention. Hinge 21 is located between second magnetically charged face 8 and short plane 15. As described above hinge 21 may be the same material and same thickness as magnet support 20. Or, hinge 21 may be of the same material and thinner than magnet support 20. Hinge 21 is located on magnet support 20 so that magnetically charged faces 8 and 14 align when the knife sheath is in the closed position.

Another embodiment of the invention using the J-shaped magnetically charged face 14 is shown in FIG. 5. In FIG. 5, the magnet support is permanently attached only to long plane 11. Hinge 21 is located between long plane 11 and second magnetically charged face 8. Hinge 21 is protected from the knife-edge by the J-shaped magnetically charged face 14. Hinge 21 allows the magnet support to curve around short planes 12 and 15, and to align magnetically charged faces 8 and 14. The second magnetically charged face 8 is thereby magnetically attracted to first magnetically charged face 14, holding the knife sheath closed. If a knife is placed in the knife sheath the magnetically charged faces will be attracted to the knife, as well, and will secure the knife in the knife sheath.

FIG. 6 shows another embodiment of the invention using only a single J-shaped magnetically charged face. In this embodiment, as described above, J-shaped magnetically charged face 14 has a long plane 11, a short plane 12, and a second short plane 15. Short plane 12 extends perpendicularly from long plane 11, as described above. Second short plane 15 extends perpendicularly form short plane 12 to form a trough. The trough must be of sufficient size to accommodate the edge of a knife blade. The inventor currently prefers a trough of about ⅛". However, it is apparent that the length of the trough may be adjusted as needed to accommodate different knife thicknesses.

J-shaped magnetically charged face 14 may be formed as a single unit. Alternatively, the long plane 11 and short planes 12 and 15 may be formed in any other manner to form a trough. The use of the phrase "J-shaped" is for identification only, and is not meant to limit the angles of connection between long plane 11 and short planes 12 and 15. Thus, short plane 12 may extend may extend perpendicularly from long plane 11 through a curve rather than a right angle. And, short plane 15 may extend perpendicularly from short plane 12 through a curve rather than a right angle. Or, as shown in FIG. 4 short planes 12 and 15 may extend at 90-degree angles.

There is no magnet support or hinge in this embodiment. The knife-edge is simply placed in trough. The knife is held in place through magnetic attraction. FIGS. 7 and 7A show seal 23. Seal 23 is an optional addition to any of the embodiments described herein. Seal 23 is made from cut-proof tape, vinyl tape, polypropylene tape, polyester tape, thermal bonding, or any other tape. Seal 23 is placed over all or a part of the first and second magnetically charged faces, and the hinge 21. Seal 23 creates a barrier to prevent food or other contaminants from getting between the magnetically charged faces and the magnet support 20 or hinge 21.

In all of the embodiments described, the magnetically charged faces adhere to magnet support 20 by virtue of either the application of adhesive, such as urethane, acrylic, epoxy glue, or other adhesive, or the application of heat to form a thermal bond. The adhesive or thermal bonding should be susceptible to washing and sterilizing, thus permitting the entire invention to be cleaned and sterilized.

In all of the described embodiments, the two magnetically charged faces are placed in such a manner that when the invention is in the closed position the magnetically charged faces are magnetically attracted to each other. The magnetic attraction of the magnetically charged faces will hold the knife sheath in a closed position and will hold the knife blade in place.

In all of the described embodiments, the hinge 21 is sufficiently flexible to allow hinge-like motion so that the invention may be repeatedly opened and closed. When in the closed position, one magnetically charged face aligns with the second magnetically charged face. Hinge 21 may be made out of the same material used for the magnet support 20. Alternatively, the hinge 21 may be any material that may be repeatedly bent without breaking. Hinge 21 may also be a living hinge, or may be made by scoring, or by a mechanical hinge.

The size and shape of the magnetically charged faces and the magnet support 22 can be varied as needed to match the different sizes of different knife blades. Typically, the entire knife blade will be completely covered by the magnetically charged faces or, the magnet support 22. However, it is not absolutely necessary to have the entire knife blade covered by the magnetically charged faces or the magnet support 22. Some knife blades, for example, large or curved knife blades, may be secured and protected by the invention as long as the sharp edge of the blade is covered.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A device for securing knives comprising a magnet support;

a first magnetically charged strip comprising a long plane and a short plane positioned adjacent and perpendicular to each other in which the short plane projects from the long plane to define an "L" shape, said first magnetically charged strip having an L-shaped inner face and a flat outer face, and wherein the outer face of the first magnetically charged strip is co-extensive with, and permanently affixed to, the magnet support, and a second magnetically charged strip with a long plane, having a flat inner face and a flat outer face, and wherein the outer face of the second magnetically charged strip is co-extensive with, and permanently affixed to, the magnet support;

a hinge located on the magnet support between the first magnetically charged strip and the second magnetically charged strip, said hinge permitting the magnet support to move between an open position and a closed position, and moveably connecting the first magnetically charged strip to the second magnetically charged strip;

wherein the hinge, first magnetic strip, and second magnetic strip are positioned so that when the hinge is in the closed position the flat inner face of the second magnetically charged strip is aligned with, and juxtaposed to, the L-shaped inner face of the first magnetically charged strip.

2. The device of claim 1 wherein the first magnetically charged strip and the second magnetically charged strip are flexible magnets.

3. The device of claim 1 in wherein the first magnetically charged strip and the second magnetically charged strip are non-flexible magnets.

4. The device of claim 1 wherein the magnet support is flexible vinyl, plastic, rubber, leather, or other flexible material.

5. The device of claim 1 wherein the magnet support is permanently affixed to the flat outer face of the second magnetically charged strip, the flat outer face of the first magnetically charged strip, and the short plane of the first magnetic strip, and the hinge is positioned between the short plane of the first magnetic strip and the second magnetic strip.

6. The device of claim 5 wherein the hinge is comprised of a thinner section of the same material as the magnet support.

7. The device of claim 1 wherein a projection projects from the magnet support and where the projection is permanently affixed to the long plane and short plane of the first magnetic strip and where the hinge is co-extensive with the magnet support and is located between the projection and the second magnetic strip.

8. The device of claim 1 wherein the inner face of the first magnetically charged strip and the inner face of the second magnetically charged strip are magnetically attracted to each other and to the knife blade, thereby securing the knife in the device.

9. The device of claim 1 wherein the magnet support is permanently affixed to only the short plane of the first magnetically charged strip and to only part of the outer face of second magnetically charged strip.

10. A device for securing knives comprising a magnet support;

a first magnetically charged strip comprising a long plane, a first short plane, and a second short plane wherein the first short plane Is positioned adjacent and perpendicular to the long plane and projects from the long plane, and the second short plane is positioned adjacent and perpendicular to the first short plane and projects from the first short plane to define a "J" shape, said first magnetically charged strip having a J-shaped inner face and a flat outer face, and wherein the outer face of the first magnetically charged strip is co-extensive with, and permanently affixed to, the magnet support, and a second magnetically charged strip with a long plane that is fiat, and having a flat inner face and a flat outer face, and wherein the outer face of the second magnetically charged strip is co-extensive with, and permanently affixed to, the magnet support;

a hinge located on the magnet support between the first magnetically charged strip and the second magnetically charged strip, said hinge permitting the magnet support to move between an open position and a closed position, and moveably connecting the first magnetically charged strip to the second magnetically charged strip;

wherein the hinge, twit magnetic strip, and second magnetic strip are positioned so that when the hinge is in the closed position the inner face of the long plane of the second magnetically charged strip is aligned with the J-shaped inner face of the first magnetically charged strip.

11. The device of claim 10 wherein the magnetically charged strips are flexible magnets.

12. The device of claim 10 in wherein the magnetically charged strips are non-flexible magnets.

13. The device of claim 10 wherein the magnet support is flexible vinyl, plastic, rubber, leather, or other flexible material.

14. The device of claim 10 wherein the magnet support is permanently affixed to the long plane, the first short plane, and the second short plane of the first magnetic strip and the hinge is positioned between the end of the second short plane and the second magnetic strip.

15. The device of claim 10 wherein the magnet support is permanently affixed to only the outer face of the long plane of the first magnetic strip and the outer face of the second magnetic strip, and the hinge is positioned between the end of the long plane and the second magnetic strip.

16. The device of claim 10 wherein the second magnetically charged face, the magnet support and the hinge are eliminated.

17. The device of claim 10 wherein the inner face of the first magnetically charged strip and the inner face of the second magnetically charged strip are magnetically attracted to each other and to the knife blade, thereby securing the knife in the device.

* * * * *